US005388286A

United States Patent [19]

Davenport

[11] Patent Number: 5,388,286

[45] Date of Patent: Feb. 14, 1995

[54] INFANT BATH SEAT DEVICE

[76] Inventor: Sharon G. Davenport, Rte. 2, Box 2025, Elkhart, Tex. 75839

[21] Appl. No.: 164,256

[22] Filed: Dec. 8, 1993

[51] Int. Cl.[6] ..... A47K 3/12

[52] U.S. Cl. ..... 4/572.1; 4/578.1; 297/464

[58] Field of Search ..... 4/571.1, 572.1, 573.1, 4/578.1, 579, 581, 582, 583, 586, 587, 588, 659, 575.1; D23/278, 303; 297/464, 485

[56] References Cited

U.S. PATENT DOCUMENTS

| | | | |
|---|---|---|---|
| D. 245,861 | 9/1977 | Elder | D23/278 |
| 2,379,340 | 6/1945 | Corbett | 4/572.1 |
| 2,424,786 | 7/1947 | Reagan, Sr. | 4/575.1 |
| 2,541,029 | 2/1951 | Burton | 4/573.1 |
| 2,698,948 | 1/1955 | Levitt | 4/586 |
| 3,528,111 | 9/1970 | Chou | 4/572.1 |
| 3,835,483 | 9/1974 | Emery et al. | 4/579 |
| 4,495,666 | 1/1985 | Herman, Jr. | 4/583 |
| 4,630,323 | 12/1986 | Sage et al. | 4/581 |
| 4,723,493 | 2/1988 | Sioni et al. | 297/464 |
| 5,123,699 | 6/1992 | Warburton | 297/464 |

*Primary Examiner*—Henry J. Recla
*Assistant Examiner*—Charles R. Eloshway
*Attorney, Agent, or Firm*—Ronald B. Sefrna

[57] ABSTRACT

An infant bath seat device, particularly useful to facilitate the bathing of an infant in a sink, generally comprises a relatively stiff three sided shell including a back wall and two parallel side walls connected to and extending outwardly from the ends of the back wall and perpendicular thereto, with a seat flap connected to and extending outwardly from the back wall in the same direction as the side walls, in a plane perpendicular to the planes of the back and side walls. The seat flap and side walls are pivotally connected to the back wall, such that the seat flap and side walls may be folded in against the back wall in a collapsed configuration for storage.

20 Claims, 3 Drawing Sheets

INFANT BATH SEAT DEVICE

FIELD OF THE INVENTION

The present invention generally relates to infant restraining devices, and in its preferred embodiments more particularly relates to a collapsible device to restrain an infant while the infant is bathed in a sink.

BACKGROUND OF THE INVENTION

The bathing of infants can be a difficult process and a frustrating experience for the parents or other caregivers. Infants tend to be very active during bath times, whether the experience is a pleasant one or an unpleasant one for the infant. Infants will grasp and pull on objects within their reach, will splash water, place objects in their mouths, etc.

When an infant is bathed in a conventional bathtub the splashing, grasping, and pulling may not, in and of themselves, cause a significant problem, but the use of a conventional bathtub is often a problem for the caregiver. A conventional bathtub is at floor level, so the caregiver must bend, stoop, kneel, etc. in very uncomfortable positions, while holding or supporting the infant. Further, the entire bathtub must be filled with water to achieve the desired depth, even though the infant occupies only a very small part of the bathtub. The prior art includes devices to be placed in a conventional bathtub to facilitate bathing, but these devices do not fully address the problems.

U.S. Pat. No. 3,528,111 to Chou, and U.S. Pat. No. 4,837,871 to Wheeler are illustrations of prior art devices designed to be placed in a conventional bathtub to position and support an infant for bathing. While these devices address some of the problems and are useful within their limitations, they do not alleviate the problems associated with the placement of the tub at floor level.

As a result of the difficulties with the use of a conventional bathtub for bathing infants, with or without support devices, alternative approaches are often used. One alternative approach involves the use of a free standing infant tub that may be placed on a counter or table. While such tubs help a caregiver eliminate the bending and some other problems associated with the use of a conventional bathtub, they create other problems. For example, water must be carried to the free standing tub, or the tub filled and then carried to the place where it will be used. Similarly, after the infant is bathed, the water must be dipped out of the free standing tub or the tub must be carried to be dumped. Further, the infant can easily splash water out of the tub onto surrounding surfaces, damaging them and/or creating a cleaning problem. In addition, the free standing tubs are large and bulky, and difficult to store.

Many caregivers bathe infants in sinks, such as a kitchen sink. Again, this approach solves many of the problems associated with the use of a conventional bathtub, and also eliminates problems with the use of free standing tubs. However, bathing an infant in a bare sink is not without problems. In a typical sink the infant can reach the sink faucet, faucet handles, and drain plug. The infant being bathed may turn faucet handles, place the faucet end in its mouth, pull the sink plug, etc. Devices intended to be placed in a sink to support an infant are known in the prior art, as illustrated by U.S. Pat. No. 4,216,552 to Gurolnick, by and U.S. Pat. No. 245,861 to Elder, for a device which could be used in a sink. However, such devices do not prevent the infant from reaching faucets, etc., and are further bulky and difficult to store. They further do not control or restrain splashing of water over the relatively low edge of the sink.

There remains a need for a simple, inexpensive, easily stored device to assist a caregiver in bathing an infant in a sink, while preventing the infant from reaching faucets, the sink plug, and other adjacent objects, and while containing splashes.

SUMMARY OF THE INVENTION

The present invention provides a simple and inexpensive device to facilitate the bathing of infants in a sink. In its preferred embodiment the device is collapsible for easy storage, and is easily opened and readied for use. The device restrains an infant from reaching faucets, handles, sink plug, and the like, and also helps stabilize and support an infant in a sitting position in the sink.

The device of the invention generally comprises a stiff three sided shell, including a back wall and two substantially parallel side walls extending from the respective ends of the back wall in substantially parallel relation to the back wall. The lengths of the back wall and the side walls are selected so that the shell will fit within a typical kitchen sink and along three of the side walls of the sink. The height of the back and side walls of the device is selected so that the upper edges of the walls extend above the upper edges of the sink to a height that will tend to block an infant from reaching over the upper edges of the walls to grasp objects beyond the walls.

The device of the invention also includes a seat flap, interconnected to the lower edge of the back wall so that the seat flap is equidistant from the side walls of the device. The seat flap extends along the bottom of the sink in a plane generally perpendicular to the planes of the back and side walls. The seat flap is dimensioned to extend along the sink bottom a sufficient distance to cover the drain and drain plug. The seat flap serves the dual function of providing a seat for an infant and preventing access to the drain plug, so that the infant cannot pull the plug and drain the bath water from the sink.

In the preferred embodiment of the device the seat flap and the side walls are pivotally connected to the back wall, so that the seat flap can be folded up along the back wall and the side walls can be folded in against the back wall. The pivotal connections allow the device to be collapsed into a thin configuration for easy transportation and storage. The pivotal connections may be made with conventional hinges, though it is preferred that the hinges be of the "self hinge" or "living hinge" type, to eliminate the possibility that an infant will be pinched between moving parts of a conventional hinge. Locking clips may be provided to lock the side walls in extended position and prevent collapse of the device during use. It is also preferred that the upper surface of the seat flap, upon which an infant will sit during bathing, have a slip resistant surface to help stabilize the infant.

The structure and features of the preferred and certain alternative embodiments of the device of the invention will be described in more detail, with reference to the accompanying drawing figures.

DETAILED DESCRIPTION OF THE PREFERRED AND ALTERNATIVE EMBODIMENTS

Figure 1:
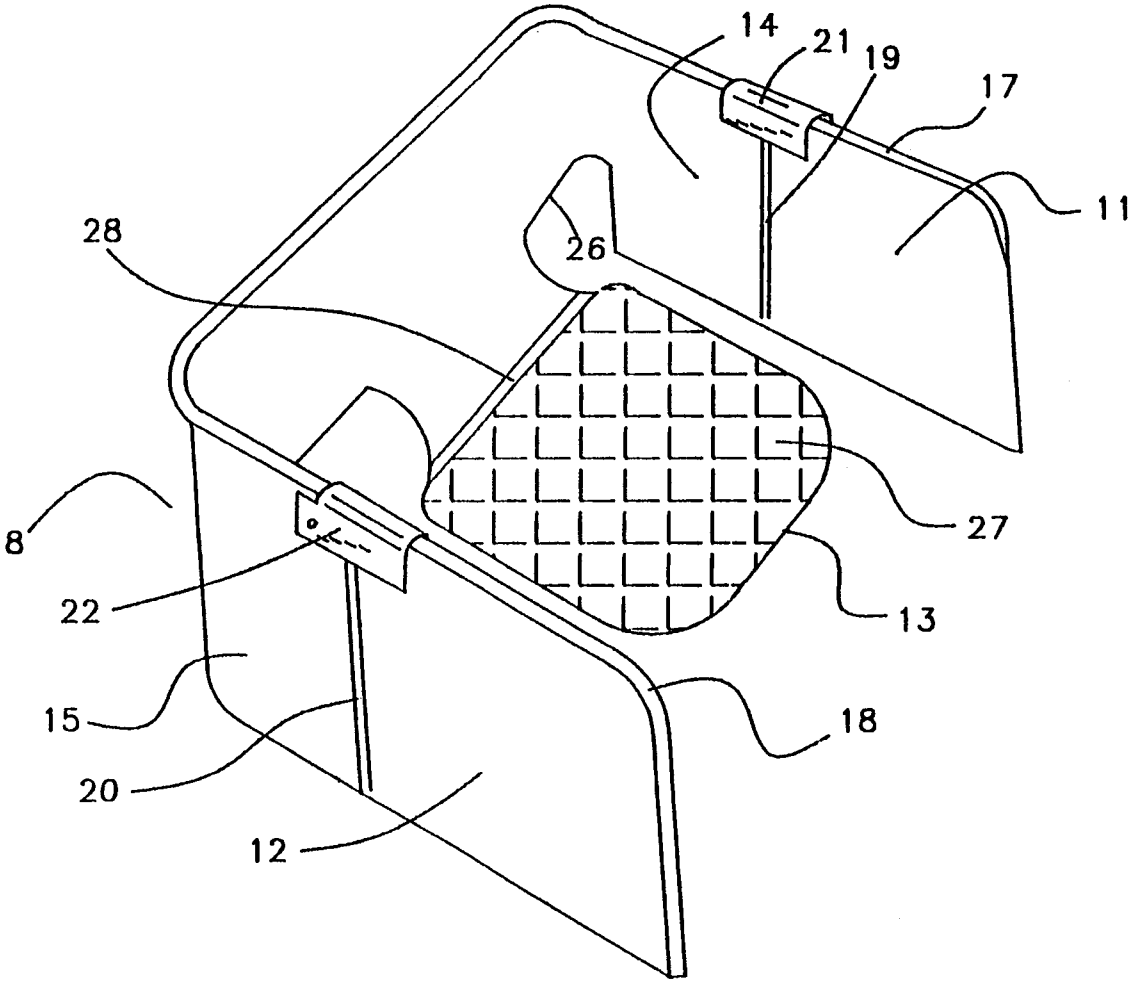
FIG. 1 is a perspective view of the preferred embodiment of the device of the invention, in opened configuration.
Figure 2:
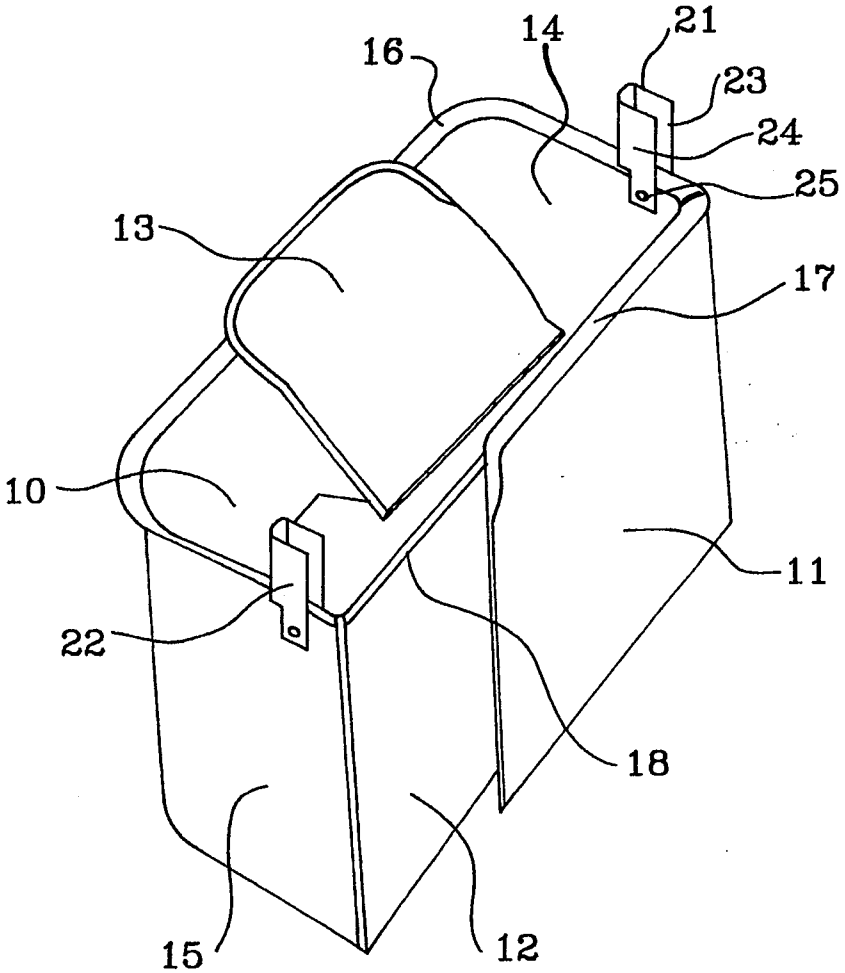
FIG. 2 is a perspective view of the preferred embodiment of the device of the invention, in collapsed configuration.
Figure 3:
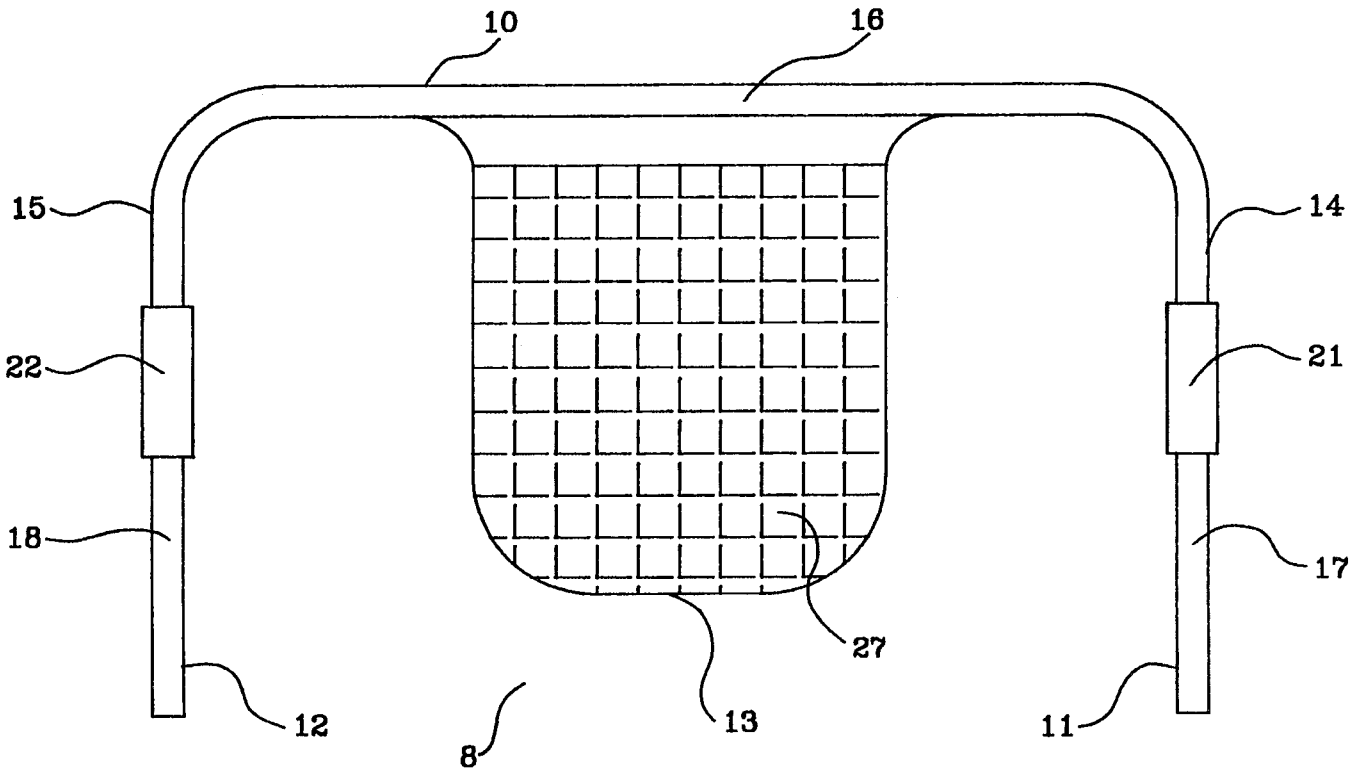
FIG. 3 is a top view of the preferred embodiment of the device of the invention, in opened configuration.

With reference to the accompanying drawing figures, particularly FIGS. 1 through 3, the device of the invention, generally designated by reference numeral 8, includes the primary components of back wall 10, side walls 11 and 12, and seat flap 13. Side walls 11 and 12 are pivotally interconnected to back wall 10 to form a three sided shell structure. Walls 10, 11, and 12 are preferably formed as stiff, thin structures, to be self supporting in an upright position with sufficient rigidity to resist bending or folding when pushed or leaned against by an infant.

As illustrated in the drawing figures, back wall 10 is preferably curved at its outer ends 14 and 15 through approximately ninety degrees, so that the end portions of back wall 10 are generally perpendicular to the intermediate portion of that wall and extend outwardly a short distance from the intermediate portion. It will be understood, however, that back wall 10 may be formed as a planar structure without curved ends if desired, though the easy collapsibility of the device may be compromised. The perpendicular extension of the ends 14 and 15 of back wall 10 provides space to accommodate seat flap 13 when folded against back wall 10, and facilitates the folding of side walls 11 and 12 against back wall 10 with seat flap 13 between the side walls and the back wall.

It is preferred that the upper edge 16 of back wall 10 be flared or curved outward from the plane defined by the major part of back wall 10, to provide a smooth contact surface for the infant. For the same reason it is preferred that the upper edges 17 and 18 of side walls 11 and 12, respectively, be flared outwardly. The outer ends of side walls 11 and 12 are also preferably flared outwardly, with a smooth crowed transition between the upper edges and the outer ends. The lower edges of walls 10, 11, and 12 are not flared, since they rest against the surface of the sink during use of the device and are not likely to be contacted by an infant. However, those lower edges could be flared if desired without departing from the scope of the invention.

The pivotal connection between each of side walls 11 and 12 and back wall 10 is made with hinges 19 and 20, respectively. In the preferred embodiment back wall 10 and side walls 11 and 12 are formed as a continuous structure of a plastic material, and hinges 19 and 20 are integral with the wall structure, each formed as a "self hinge" or "living hinge". More specifically, hinges 19 and 20 are formed by reducing the thickness of the wall structure at the hinge line, with a flexible web of wall material connecting the respective side and back wall. However, it will be understood that other types conventional hinges may be used, although exposure of an infant to moving hinge components will introduce the risk of pinching.

In the preferred embodiment, clips 21 and 22 and provided to retain side walls 11 and 12 in an open position relative to back wall 10 and prevent the side walls from folding toward the back wall during use of the device. As illustrated in FIGS. 1 and 2, each of clips 21 and 22 includes an elongate U-shaped body that is pivotally connected to the perpendicular extensions of back wall 10. Using clip 21 as an example, and referring to the illustration in FIG. 2, each clip includes parallel legs 23 and 24 to extend over the upper edges of the extension of the back wall and the side wall with those walls in parallel alignment, and is pivotable around pin 25. Clip 21 may be pivoted upward so that legs 23 and 24 clear the wall edges, allowing the side wall to be folded against the back wall. The distance between legs 23 and 24 may be sufficient to clear the flared edges of the side and back walls, or those flares may be omitted from the portion of the walls associated with the clip and the distance between the clip legs reduced accordingly.

In an alternative embodiment, pin 25 may be omitted and clips 21 and 22 may be provided as slide clips that slide longitudinally along the upper edges of the respective side walls and back wall between a position exposing the hinge line and a position covering the hinge line. Other means of retaining side walls 11 and 12 in an open position may also be used within the scope of the invention, with appropriate attention given to preventing injury to an infant bathed in the device.

Seat flap 13 is interconnected to lower edge 26 of back wall 10, and extends outwardly therefrom. With the device of the invention configured for use, seat flap 13 extends in a plane perpendicular to the planes of the back and side walls, and will lie against the bottom of a sink in which the device is placed. Seat flap 13 extends outward from back wall 10 a sufficient distance to cover the sink drain and drain plug and to provide a seat for an infant placed within the device. It is preferred that seat flap 13 be sufficiently rigid to bridge over the drain opening and support an infant, but with sufficient flexibility to conform to the sink bottom and provide a comfortable seat. The upper surface of seat flap 13 to be contacted by an infant is preferably formed to be slip resistant by inclusion of slightly raised texture elements as identified in FIG. 1 with numeral 27. Any texture pattern consistent with the intended use may be utilized.

Seat flap 13 is pivotally connected to back wall 10 by hinge 28, so that seat flap 13 may be folded up against back wall 13 when device 8 is not in use. It is preferred that seat flap 13 and back wall 10 be formed as a single unit, with hinge 28 formed as a "self hinge" or "living hinge" as described with regard to hinges 19 and 20. However, as with hinges 19 and 20, other hinge types may be used, though the inclusion of moving hinge parts will increase the risk of pinching an infant placed within the device for bathing.

The device of the invention is prepared for use by folding out and retaining side walls 11 and 12, retaining them in their extended positions, and placing the device in a sink. The sink drain is plugged or closed and seat flap 13 is folded down upon the bottom of the sink, either before or after the sink is filled to the desired level with water, preparing the device to receive an infant for bathing. The height of the back and side walls is sufficient that an infant sitting in the sink on seat flap 13 will be unable to readily reach over the side walls to grasp objects such as a faucet or faucet handles. Since the sink drain is covered by seat flap 13, the infant will be unable to reach the sink plug or drain closure and cannot open the drain prematurely. When the bathing is completed and the infant removed from the sink, the seat flap is folded up against the back wall and the side walls are folded in against the seat flap and back wall, collapsing the device into a compact configuration for storage.

The foregoing description of the preferred and alternative embodiments of the invention is illustrative and not for purposes of limitation. The device of the invention is susceptible to additional modifications and alternative embodiments within the scope of the invention as claimed.

What is claimed is:

1. An infant bath seat device comprising a generally planar back wall, generally defining a back wall plane, having an upper edge, a lower edge, a first side edge, and a second side edge, said back wall being curved through an angle of about 90 degrees immediately adjacent to each of said first and second side edges such that a narrow strip adjacent to each side edge extends generally perpendicular to said back wall plane and generally parallel to the other said narrow strip;

a first generally planar side wall, generally defining a first side wall plane, having an upper edge, a lower edge, a rear edge, and a front edge, interconnected at its rear edge to said first side edge of said back wall and extending outward from said back wall with said first side wall plane substantially perpendicular to said back wall plane;

a second generally planar side wall, generally defining a second side wall plane, having an upper edge, a lower edge, a rear edge, and a front edge, interconnected at its rear edge to said second side edge of said back wall and extending outward from said back wall with said second side wall plane substantially perpendicular to said back wall plane and with said second side wall plane substantially parallel to said first side wall plane; and a generally planar seat flap, generally defining a seat flap plane, having a rear edge, a front edge, a first side edge, and a second side edge, interconnected at its rear edge to said lower edge of said back wall intermediate said first and second side edges of said back wall, and extending outwardly from said back wall with said seat flap plane generally perpendicular to said back wall plane and to said first and second side wall planes.

2. The infant bath seat device of claim 1, wherein said first and second side walls are pivotally interconnected to said back wall, such that said first and second side walls may be folded into generally parallel alignment with said back wall, and wherein said seat flap is pivotally interconnected to said back wall, such that said seat flap may be folded into generally parallel alignment with said back wall and with said side walls.

3. The infant bath seat device of claim 2, wherein said back wall and said side walls are sufficiently rigid to substantially support an infant leaning against the respective upper edges thereof.

4. The infant bath seat device of claim 2, further comprising a first clip means to releasably retain said first side wall in an unfolded position extending generally perpendicular to said back wall, and a second clip means to releasably retain said second side wall in an unfolded position extending generally perpendicular to said back wall.

5. The infant bath seat device of claim 4, wherein each of said first and second clip means comprises a generally U-shaped body to be selectively positioned so as to bridge the interconnection between said back wall and the respective one of said side walls along the respective upper edges of said walls, said body having a pair of generally parallel legs to be received over said upper edges of said walls, and a pivot pin extending through coaxially aligned apertures in said body and through a matching aperture in one of said walls, about which said body is pivoted to selectively engage said legs of said body with and disengage said legs of said body from said walls.

6. The infant bath seat device of claim 2, wherein said upper edge of said back wall is flared outwardly from said back wall plane opposite the extension of said side walls therefrom, and wherein the upper edge of each of said side walls is flared outwardly from said side wall plane away from the other one of said side walls.

7. The infant bath seat device of claim 6, wherein said front edge of each of said side walls is flared outwardly from said side wall plane of said side wall away from the other one of said side walls.

8. The infant bath seat device of claim 2, wherein said back wall, said first and second side walls, and said seat flap are formed as a continuous structure, and wherein said pivotal interconnections between said first side wall and said back wall, between said second side wall and said back wall, and said seat flap and said back wall are formed as self-hinges in said continuous structure.

9. The infant bath seat device of claim 1, wherein said seat flap has an upper surface and a lower surface, and wherein said upper surface of said seat flap includes slip resisting means.

10. The infant bath seat device of claim 9, wherein said slip resisting means is a surface texture formed on said upper surface of said seat flap.

11. A folding infant bath seat device to be disposed in a conventional sink having sink walls, a sink base, and a drain in the sink base, for the purpose of bathing an infant therein, comprising a back wall having an upper edge, a lower edge, a first side edge, and a second side edge, said back wall being generally planar, and said back wall being curved through an angle of about 90 degrees immediately adjacent to each of said first and second side edges such that a narrow strip adjacent to each side edge extends between said upper edge and said lower edge generally perpendicular to said back wall and in parallel relation to the other said narrow strip;

a first generally planar side wall having an upper edge, a lower edge, a rear edge, and a front edge, pivotally interconnected at its rear edge to said first side edge of said back wall and extending outward from said back wall, such that said first side wall may be selectively folded to a position generally parallel to said back wall and to a position generally perpendicular to said back wall;

a second generally planar side wall having an upper edge, a lower edge, a rear edge, and a front edge, pivotally interconnected at its rear edge to said second side edge of said back wall and extending outward from said back wall, such that said second side wall may be selectively folded to a position generally parallel to said back wall and to a position generally perpendicular to said back wall; and a generally planar seat flap having a rear edge, a front edge, a first side edge, and a second side edge, pivotally interconnected at its rear edge to said lower edge of said back wall intermediate said first and second side edges of said back wall, and extending outwardly from said back wall such that said seat flap may be selectively folded to a position generally parallel to said back wall and to a position with the plane of said seat flap generally perpendicular to said back wall and to said first and second side walls.

12. The folding infant bath seat device of claim 11, wherein said back wall and said side walls are of sufficient height between said lower edges and said upper edges thereof to extend upwardly beyond said walls of said conventional sink.

13. The folding infant bath seat device of claim 11, wherein said seat flap extends outwardly from said back wall a sufficient distance to cover said drain of said conventional sink.

14. The folding infant bath seat device of claim 11, wherein a portion of said back wall adjacent to said upper edge thereof is flared outwardly opposite the extension of said side walls from said back wall, and wherein a portion of each of said side walls adjacent to the upper edge thereof is flared outwardly away from the other one of said side walls.

15. The folding infant bath seat device of claim 14, further comprising a first clip means to releasably retain said first side wall in an unfolded position extending generally perpendicular to said back wall, and a second clip means to releasably retain said second side wall in an unfolded position extending generally perpendicular to said back wall, and wherein each of said first and second clip means includes a generally U-shaped body slidably disposed on said upper edge of the respective one of said side walls such that said body may be selectively positioned across the interconnection between said back wall and the respective one of said side walls along the respective upper edges of said walls, said body having a pair of generally parallel legs extending over said upper edges of said walls with one of said legs on each side thereof.

16. The folding infant bath seat device of claim 11, wherein said front edge of each of said side walls is flared outwardly away from the other one of said side walls.

17. The folding infant bath seat device of claim 11, further comprising a first clip means to releasably retain said first side wall in an unfolded position extending generally perpendicular to said back wall, and a second clip means to releasably retain said second side wall in an unfolded position extending generally perpendicular to said back wall, and wherein each of said first and second clip means includes a generally U-shaped body to be selectively positioned so as to bridge the interconnection between said back wall the the respective one of said side walls along the respective upper edges of said walls, said body having a pair of generally parallel legs to be received over said upper edges of said walls, and a pivot pin extending through coaxially aligned apertures in said body and through a matching aperture in one of said walls, about which said body is pivoted to selectively engage said legs of said body with and disengage said legs of said body from said walls.

18. The folding infant bath seat device of claim 11, wherein said seat flap is formed with a slip resistant surface texture.

19. The folding infant bath seat device of claim 11 wherein said back wall, said side walls, and said seat flap are formed as a continuous structure, and wherein the pivotal interconnections between said first side wall and said back wall, between said second side wall and said back wall, and between said seat flap and said back wall comprise self hinge means formed in said continuous structure.

20. The folding infant bath seat device of claim 19, wherein each of said self hinge means comprises a flexible web extending between the pivotally interconnected components.

* * * * *